US011335215B2

(12) United States Patent
Eden

(10) Patent No.: US 11,335,215 B2
(45) Date of Patent: May 17, 2022

(54) ILLUMINATED LABEL HOLDER DEVICE

(71) Applicant: Keith C. Eden, Rockford, IL (US)

(72) Inventor: Keith C. Eden, Rockford, IL (US)

(73) Assignee: Fasteners for Retail, Inc., Twinsburg, OH (US)

( * ) Notice: Subject to any disclaimer, the term of this patent is extended or adjusted under 35 U.S.C. 154(b) by 48 days.

(21) Appl. No.: 16/888,685

(22) Filed: May 30, 2020

(65) Prior Publication Data

US 2021/0375161 A1 Dec. 2, 2021

(51) Int. Cl.
*G09F 3/18* (2006.01)
*G09F 3/20* (2006.01)
*G09F 13/04* (2006.01)

(52) U.S. Cl.
CPC ..... *G09F 3/204* (2013.01); *G09F 13/0413* (2013.01)

(58) Field of Classification Search
CPC .. G09F 3/204; G09F 13/0413; G09F 2013/18; G09F 13/18; G02B 6/00; G02B 6/0011; F21V 2200/20; F21W 2131/405; A47F 11/10
See application file for complete search history.

(56) References Cited

U.S. PATENT DOCUMENTS 9,679,503 B2 6/2017 Weyer
2007/0230212 A1* 10/2007 Misof ..... A47F 11/10 362/600
2014/0153279 A1* 6/2014 Weyer ..... F21S 4/20 362/604
2016/0195662 A1* 7/2016 Ma ..... G02B 6/0073 362/382
2019/0231068 A1* 8/2019 Breslow ..... A47F 1/126

FOREIGN PATENT DOCUMENTS

CN 206159955 U * 5/2017
CN 208997721 U * 6/2019
DE 3612296 A1 * 10/1987 ..... G09F 13/04
WO WO-2018103237 A1 * 6/2018 ..... F21V 17/16
WO WO-2020254652 A1 * 12/2020 ..... F21V 19/003

* cited by examiner

*Primary Examiner* — Cassandra Davis
(74) *Attorney, Agent, or Firm* — Reinhart Boerner Van Deuren P.C.

(57) ABSTRACT

A shelf illumination device that includes a label holder configured to hold a label and also configured for removable attachment to a front-facing end of a retail store shelf. The device includes a light bar having a plurality of light sources positioned along a length of the light bar, and with a handle attached to one end of the light bar. A carrier has a first flat portion that extends for a length at least as long the light bar. The carrier further includes a first projection and a second projection that together define an opening configured to hold the light bar. The carrier is configured for assembly to the label holder. A light-conducting member is sandwiched between the label holder and the carrier. The light-conducting member has an edge configured to receive light from a source and to conduct that light throughout the entire light-conducting member.

16 Claims, 6 Drawing Sheets

ILLUMINATED LABEL HOLDER DEVICE

FIELD OF THE INVENTION

This invention generally relates to an illumination device for a retail store shelf.

BACKGROUND OF THE INVENTION

Due to the variations in the amount and location of overhead lighting in retail settings, it is often the case that the labeling on retail store shelves is not properly illuminated. Especially for those labels on or near a bottom shelf, visibility may be relatively poor for many consumers such that reading the label is impossible for certain consumers whose vision is impaired in some way. Thus, it would be desirable to have a way to illuminate such labels so that regardless of its location on the store shelf, the label will be properly illuminated. A Shelf Illumination Device is disclosed in U.S. Pat. No. 9,679,503 issued to Andreas Weyer, the entire disclosure of which is incorporated herein by reference thereto.

Embodiments of the invention provides such a means for illumination of labeling on any store shelf. These and other advantages of the invention, as well as additional inventive features, will be apparent from the description of the invention provided herein.

BRIEF SUMMARY OF THE INVENTION

In one aspect, embodiments of the invention provide a shelf illumination device that includes a label holder configured to hold a label and also configured for removable attachment to a front-facing end of a retail store shelf. The device includes a light bar having a plurality of light sources positioned along a length of the light bar, and with a handle attached to one end of the light bar. A carrier has a first flat portion that extends for a length at least as long the light bar. The carrier further includes a first projection and a second projection that together define an opening configured to hold the light bar. The carrier is configured for assembly to the label holder. A light-conducting member is sandwiched between the label holder and the carrier. The light-conducting member has an edge configured to receive light from a source and to conduct that light throughout the entire light-conducting member.

In a particular embodiment, the light-conducting member has a planar portion and a curved portion. In a more particular embodiment, the edge of the light-conducting member is at an end of the curved portion. The light bar may be battery-powered, and the handle may be configured to store a battery for powering the light bar.

In some embodiments, the first and second projections form a substantially rectangular opening configured to receive the light bar. In a further embodiment, the light bar is shaped as a rectangular prism such that the light bar can slide in an out of the rectangular opening defined by the first and second projections. Furthermore, the first and second projections may project from a second flat portion that connects to the first flat portion at an angle such that the first flat portion and the second flat portion are not coplanar. In some embodiments, the carrier includes a third projection proximate the second projection such that the second and third projections for a second opening configured to hold a second light bar. In other embodiments, the second flat portion is angled such that the second light bar is positioned to illuminate merchandise on a shelf below the shelf illumination device.

Additionally, the plurality of light sources may include a plurality of LEDs. In certain embodiments, the edge of the light-conducting member abuts the light bar. In a further embodiment, the carrier has a third projection proximate the second projection such that the second and third projections for a second opening configured to hold a second light bar.

In a particular embodiment, the second opening is substantially rectangular. Also, the carrier may include a third flat portion that connects to the second flat portion at an angle such that the third flat portion is not coplanar with the second flat portion or with the first flat portion. In some embodiments, the light-conducting member is transparent. In some embodiments, the label holder is transparent. In a further embodiment, the light bar is elongate.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
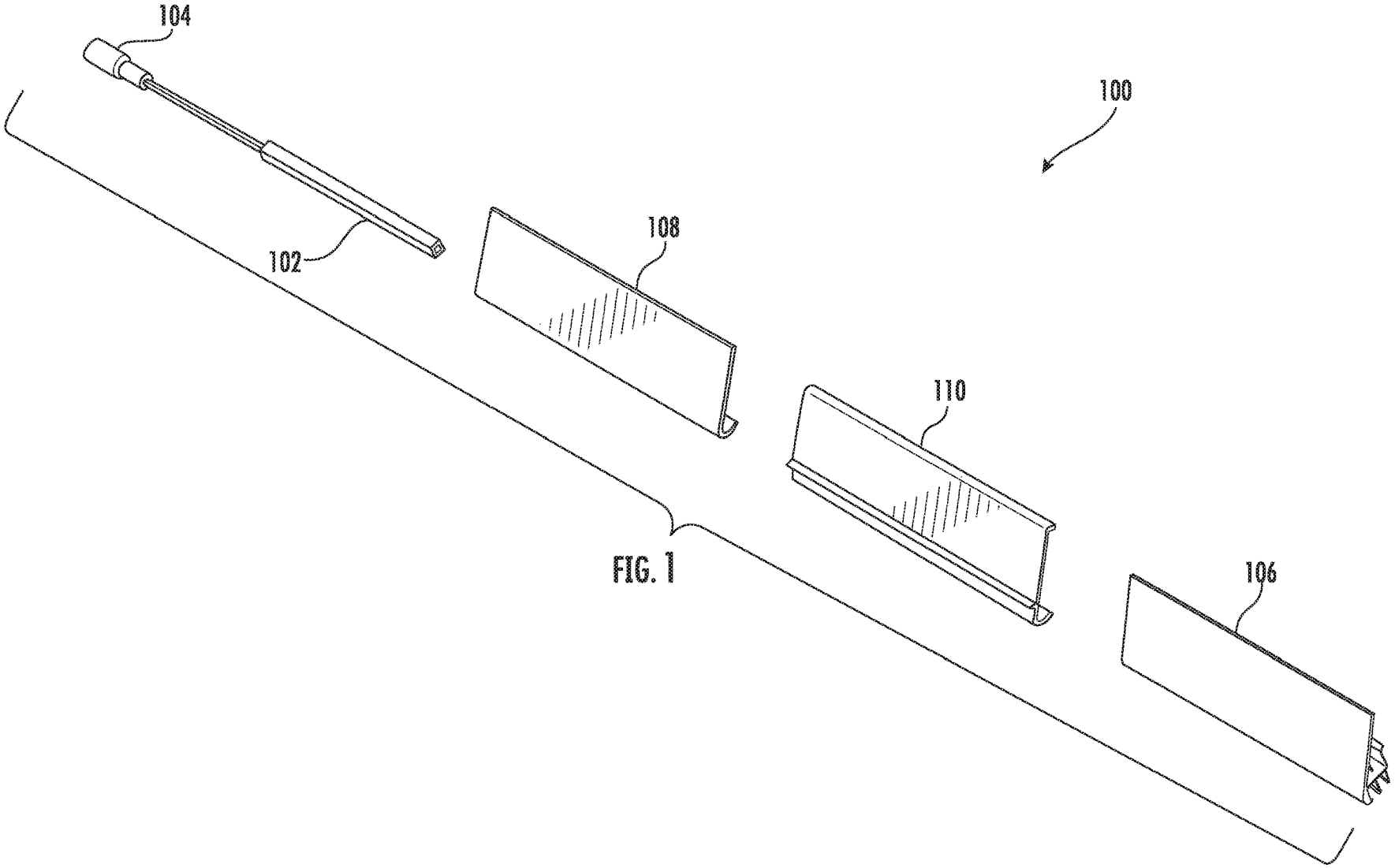
FIG. 1 is an exploded perspective view of a shelf illumination device, in accordance with an embodiment of the invention.
Figure 2:
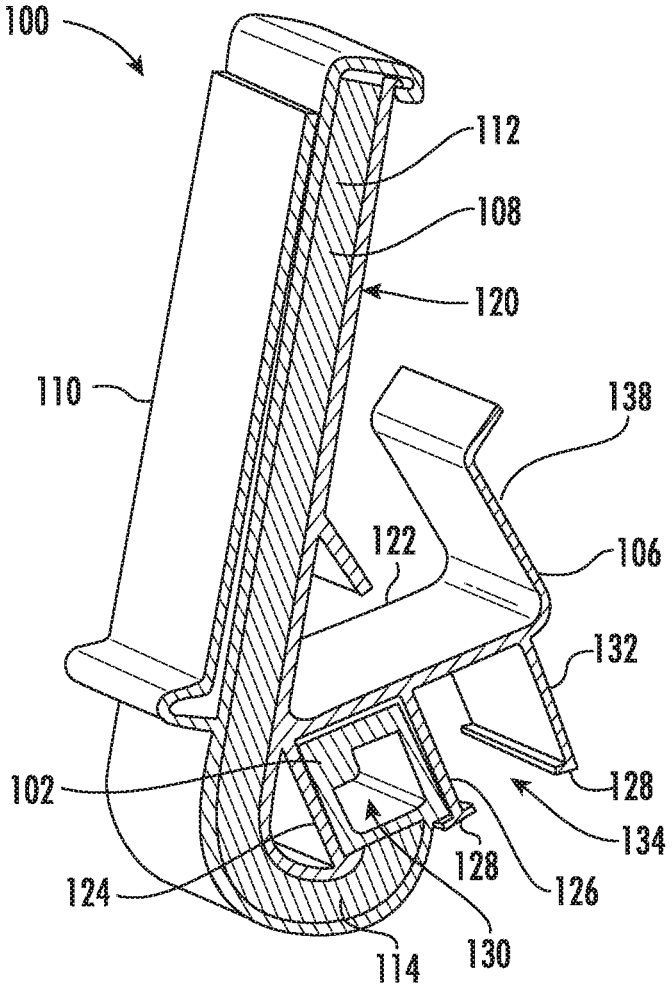
FIGS. 2 and 3 are perspective views of the shelf illumination device, according to an embodiment of the invention.
Figure 3:
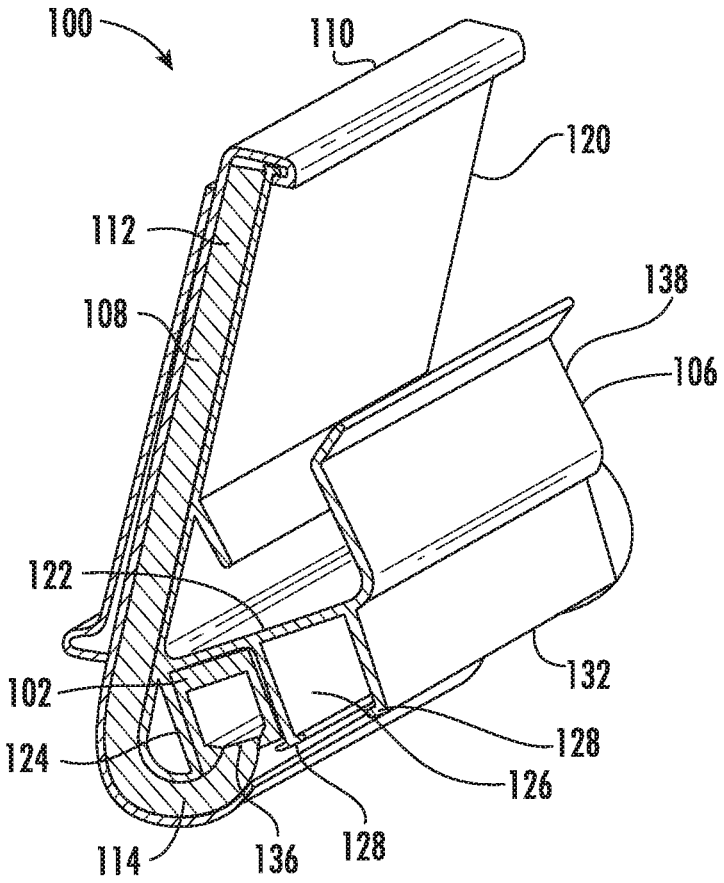
Figure 4:
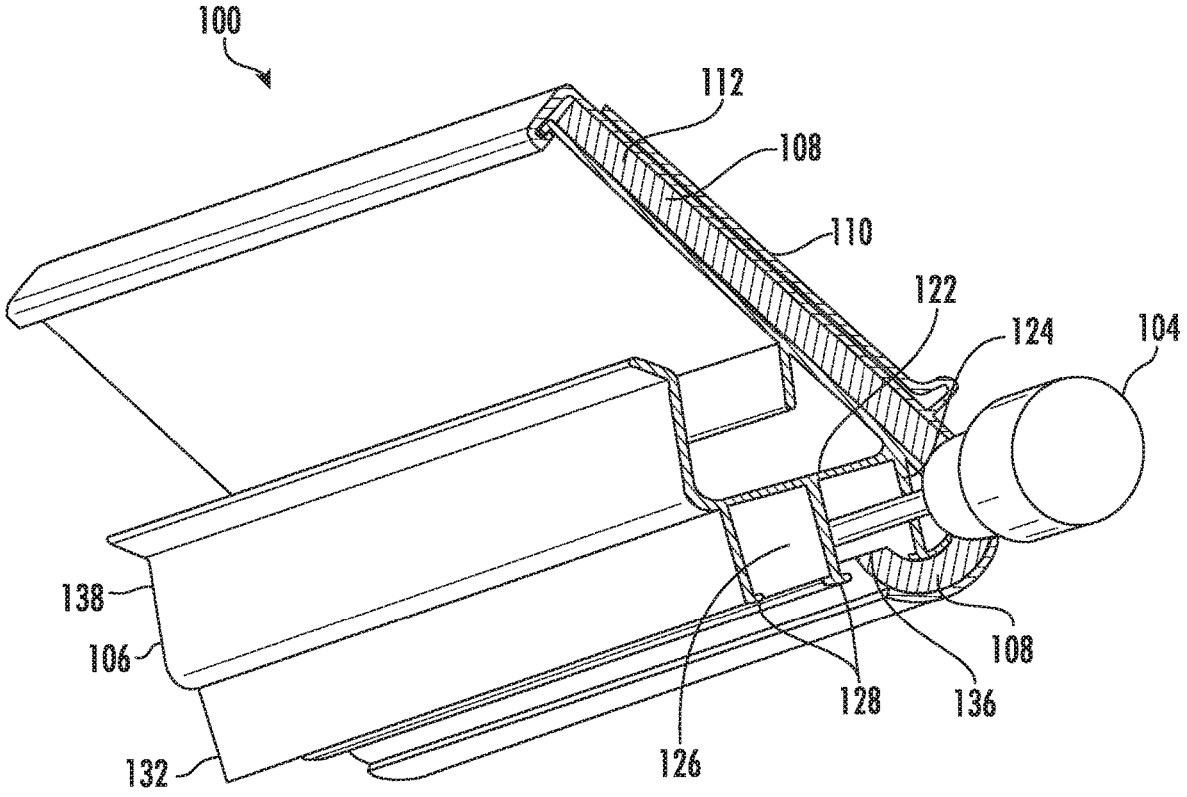
FIGS. 4 and 5 are perspective views of the shelf illumination device showing the handle for the light bar, according to an embodiment of the invention.
Figure 5:
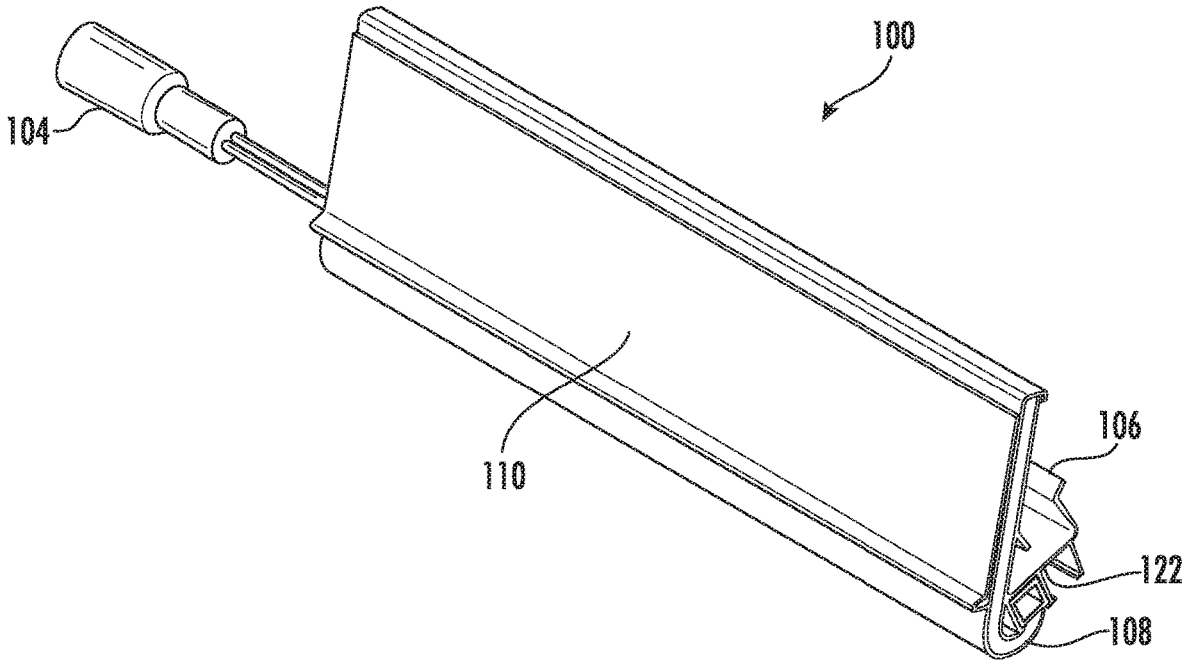

FIG. 1 is an exploded perspective view of a shelf illumination device 100, in accordance with an embodiment of the invention. The shelf illumination device 100 includes a light bar 102 having a plurality of light sources along its length. The light sources may be LEDs, or more conventional light sources. In certain embodiments, such as that shown in FIG. 1, the light bar is elongate, and may be shaped as a rectangular prism. The light bar 102 has a handle 104 to allow a user to manipulate the light bar 102. The handle 104 may be configured to hold a battery that supplies power to the plurality of light sources. In other embodiments, the shelf illumination device 100 includes a transformer coupled to a cord for plugging into a standard electrical outlet.

The shelf illumination device 100 further includes a carrier 106, a light-conducting member 108, and a label holder 110. FIGS. 2-5 show the assembled shelf illumination device 100 from different perspective view, according to an embodiment of the invention. As can be seen, the carrier 106 is assembled to the label holder 110, the light-conducting member 108 being sandwiched between the label holder 110 and the carrier 106.

In particular embodiments, the light-conducting member 108 has a flat portion 112 and a curved portion 114. The flat portion 112 of the light-conducting member 108 is sandwiched between the label holder 110 and the carrier 106. The carries 106 has a first flat portion 120, which abuts the flat portion 112 of the light-conducting member 108. The carries 106 has a second flat portion 122 connected to the first flat portion 120 at an angle, i.e., a non-zero angle, such that the first flat portion 120 and the second flat portion 122 are not coplanar.

In the embodiments shown, a first projection 124 extends downward at a right angle from the second flat portion 122. A second projection 126 extends downward at a right angle from the second flat portion 122 and parallel to the first projection 124. At the end of the first and second projections 124, 126, there are perpendicular extensions 128 such that the first and second projections 124, 126 form a first substantially rectangular space or opening 130. In this case, "substantially" refers to the fact that the rectangular opening 130 is fully enclosed on three sides and partially enclosed on the fourth side where the perpendicular extensions 128 are too short to full enclose the fourth side.

A third projection 132 extends downward at a right angle from the second flat portion 122 and parallel to the second projection 126. The third projection 132 has the perpendicular extension 128 such that the second and third projections 126, 132 substantially form a second rectangular space or opening 134 that is fully enclosed on three sides and partially enclosed on the fourth side.

As shown in the FIGS. 2-5 embodiment, the carrier 106 may include a third flat portion 138 that connects to the second flat portion 122 at an angle such that the third flat portion 138 is not coplanar with the second flat portion 122 or with the first flat portion 120. The third flat portion 138 may serve as a handle-like function allowing for manual manipulation of the carrier 106.

The light bar 102, which in the embodiments shown, is shaped as a rectangular prism is inserted into the first rectangular opening 130. The handle 104 of the light bar 102 can be used to insert or remove the light bar 102 from the first rectangular opening 130 of the carrier 106. As can be seen, the light bar 102, when inserted into the first rectangular opening 130, abuts an edge 136 of the light-conducting member 108. In the embodiments shown, the edge 136 is at the end of the curved portion 114 of the light-conducting member 108. From this edge 136, light from the light bar 102 is conduct throughout the curved and flat portions 114, 112 of the light-conducting member 108. This light in the light-conducting member 108 provides backlighting to illuminate any label within the label holder 110.

Figure 6:
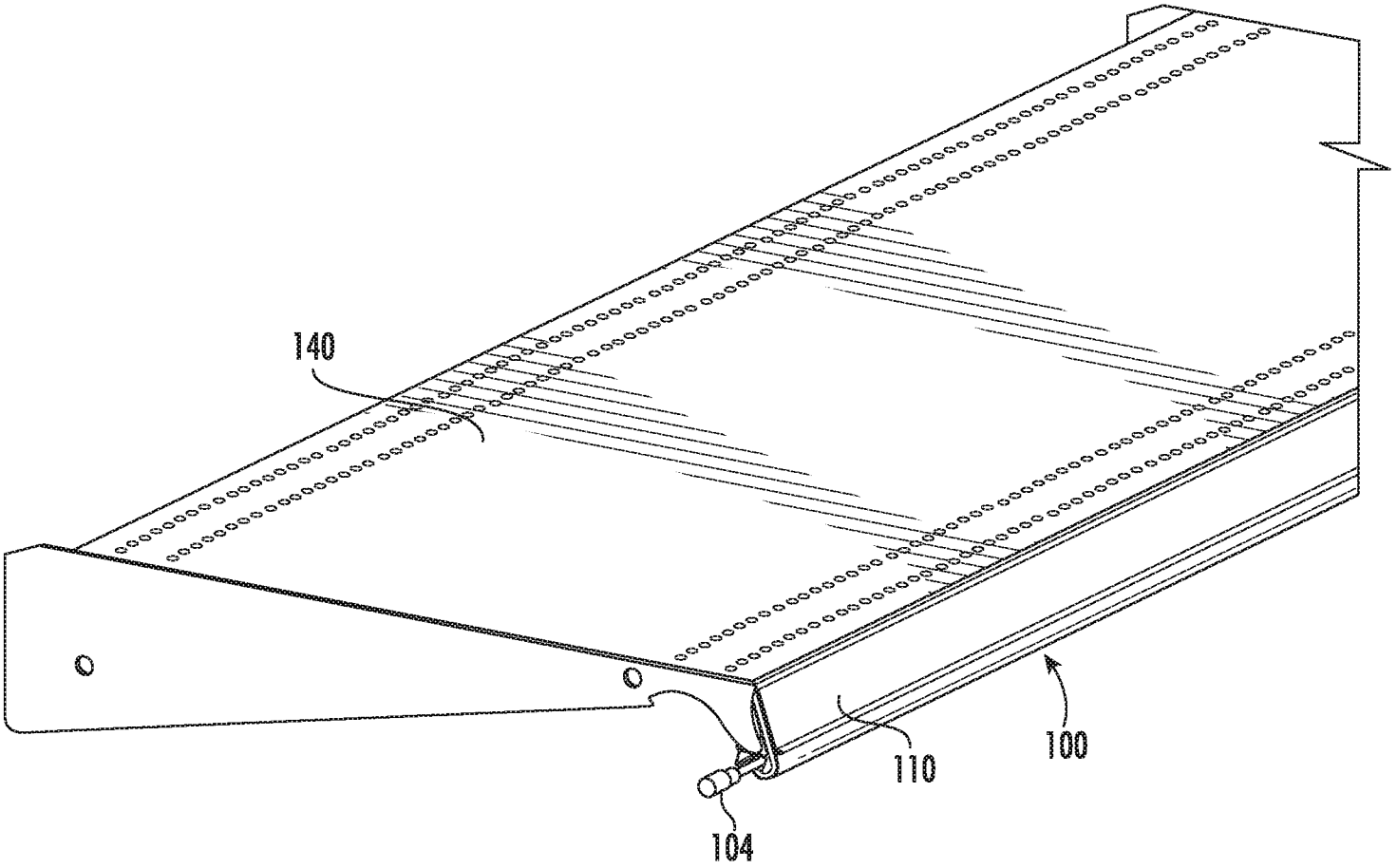
FIG. 6 is a perspective view of the shelf illumination device attached to a retail store shelf, in accordance with an embodiment of the invention.

It can be seen from FIGS. 2-5 that the second rectangular space or opening 134 is configured to hold a second light bar 102. In these embodiments, the second flat portion 122 of the carrier 106 is angled such that the second light bar 102 would illuminate merchandise on a shelf below the shelf with the shelf illumination device 100. This can be seen from the embodiment of FIG. 6 which shows a perspective view of the shelf illumination 100 device attached to a retail store shelf 140, in accordance with an embodiment of the invention. FIG. 6 shows the second flat portion 122 of the carrier 106 configured in a way that light from the second light bar 102 in the second rectangular opening 134 would be directed below the shelf 140 with the shelf illumination device 100. In this way, the light from the second light bar 102 illuminates merchandise on a shelf below shelf 140.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A shelf illumination device comprising:

a label holder configured to hold a label and also configured for removable attachment to a front-facing end of a retail store shelf;

a light bar positioned along a length of the light bar, and with a handle attached to one end of the light bar;

a carrier having a first flat portion that extends for a length at least as long as that of the light bar, the carrier further including a first projection and a second projection that together define an opening configured to hold the light bar, the carrier configured for assembly to the label holder; and a light-conducting member sandwiched between the label holder and the carrier, the light-conducting member having an edge configured to receive light from the light bar and to conduct that light throughout the entire light-conducting member;

wherein the first and second projections project from a second flat portion that connects to the first flat portion at an angle such that the first flat portion and the second flat portion are not coplanar.

2. The shelf illumination device of claim 1, wherein the light-conducting member has a planar portion and a curved portion.

3. The shelf illumination device of claim 2, wherein the edge of the light-conducting member is at an end of the curved portion.

4. The shelf illumination device of claim 1, wherein the light bar is battery-powered.

5. The shelf illumination device of claim 4, wherein the handle is configured to store a battery for powering the light bar.

6. The shelf illumination device of claim 1, wherein the first and second projections form a substantially rectangular opening configured to receive the light bar.

7. The shelf illumination device of claim 1, wherein the light bar is shaped as a rectangular prism such that the light bar can slide in an out of the rectangular opening defined by the first and second projections.

8. The shelf illumination device of claim 1, wherein the carrier includes a third projection proximate the second projection such that the second and third projections form a second opening configured to hold a second light bar.

9. The shelf illumination device of claim 8, wherein the second flat portion is angled such that the second light bar is positioned to illuminate merchandise on a shelf below the shelf illumination device.

10. The shelf illumination device of claim 1, wherein the edge of the light-conducting member abuts the light bar.

11. The shelf illumination device of claim 1, wherein the carrier includes a third flat portion that connects to the second flat portion at an angle such that the third flat portion is not coplanar with the second flat portion or with the first flat portion.

12. The shelf illumination device of claim 1, wherein the carrier includes a third projection such that the second and third projections form a second opening.

13. The shelf illumination device of claim 12, wherein the second opening is substantially rectangular.

14. The shelf illumination device of claim 1, wherein the light-conducting member is transparent.

15. The shelf illumination device of claim 1, wherein the label holder is transparent.

16. The shelf illumination device of claim 1, wherein the light bar is elongate.

* * * * *